US012607075B1

(12) United States Patent
McCormick

(10) Patent No.: US 12,607,075 B1
(45) Date of Patent: Apr. 21, 2026

(54) DEVICE FOR CENTERING A SENSOR ASSEMBLY IN A BORE

(71) Applicant: Petromac IP Limited, Auckland (NZ)

(72) Inventor: Stephen Peter McCormick, Auckland (NZ)

(73) Assignee: Petromac IP Limited, Auckland (NZ)

( * ) Notice: Subject to any disclaimer, the term of this patent is extended or adjusted under 35 U.S.C. 154(b) by 0 days.

(21) Appl. No.: 19/373,975

(22) Filed: Oct. 30, 2025

(30) Foreign Application Priority Data

Aug. 11, 2025 (NZ) ..... 824169

(51) Int. Cl.
*E21B 17/10* (2006.01)
*E21B 47/01* (2012.01)

(52) U.S. Cl.
CPC ..... *E21B 17/1021* (2013.01); *E21B 47/01* (2013.01)

(58) Field of Classification Search
CPC ..... E21B 17/1021; E21B 47/01
See application file for complete search history.

(56) References Cited

U.S. PATENT DOCUMENTS 3,982,606 A 9/1976 Berry
4,171,031 A * 10/1979 Marquis ..... E21B 23/14 340/856.1
4,876,672 A 10/1989 Petermann
4,974,446 A * 12/1990 Vigneaux ..... G01N 22/04 73/152.55
5,631,413 A 5/1997 Young
9,863,198 B2 1/2018 Mccormick
10,947,791 B1 3/2021 Mccormick
10,947,792 B1 3/2021 Mccormick
10,988,991 B1 4/2021 Mccormick
11,111,774 B2 9/2021 Mccormick
11,136,880 B1 10/2021 Mccormick
11,371,296 B2 6/2022 Mccormick
11,713,627 B1 8/2023 Mccormick
2011/0138903 A1* 6/2011 Large ..... E21B 17/1021 73/152.17
2018/0003027 A1* 1/2018 Donzier ..... E21B 47/10
2020/0284115 A1* 9/2020 Delgado ..... E21B 29/02
2020/0362645 A1 11/2020 Donzier
2022/0275690 A1 9/2022 Montoya
2023/0243220 A1* 8/2023 Fanini ..... E21B 47/09 166/241.5

* cited by examiner

*Primary Examiner* — David Carroll
(74) *Attorney, Agent, or Firm* — Niels Haun; Dann, Dorfman, Herrell & Skillman, P.C.

(57) ABSTRACT

A centering device is connected to a rotating sensor assembly located at the bottom end of a tool string. The device comprises a centraliser with a plurality of arms spaced circumferentially apart around a longitudinal central axis of the device, and a shaft with a mount for fixing the shaft to the rotating sensor assembly. The shaft extends below the rotating sensor assembly, and the shaft and rotating sensor assembly rotate together on the longitudinal central axis. The centraliser is rotationally mounted to the shaft to allow the shaft to rotate within the centraliser and with the centraliser positioned below the rotating sensor assembly.

20 Claims, 4 Drawing Sheets

DEVICE FOR CENTERING A SENSOR ASSEMBLY IN A BORE

RELATED APPLICATIONS

This application claims benefit of New Zealand Provisional Patent Application No. 824169, filed on Aug. 11, 2025, entire contents of which are incorporated herein by reference.

TECHNICAL FIELD

This invention relates to devices for use in centering sensor equipment in a bore such as a pipe, a wellbore or a cased wellbore, and in particular to devices for use in centering sensor equipment in wireline logging applications.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth in the wellbore. The logging tool is lowered on a wireline-being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Oil wells are typically drilled in sequential sections. The wellbore is "spudded" with a large diameter drilling bit to drill the first section. The first section of casing is called the conductor pipe. The conductor pipe is cemented into the new wellbore and secured to a surface well head. A smaller drill bit passes through the conductor pipe and drills the surface hole to a deeper level. A surface casing string is then run in hole to the bottom of the hole. This surface casing, commonly 20" (nominal OD) is then cemented in place by filling the annulus formed between the surface casing and the new hole and conductor casing. Drilling continues for the next interval with a smaller bit size. Similarly, intermediate casing (e.g. 13⅜") is cemented into this hole section. Drilling continues for the next interval with a smaller bit size. Production casing (e.g. 9⅝" OD) is run to TD (total depth) and cemented in place. A final casing string (e.g. 7" OD) is cemented in place from a liner hanger from the previous casing string. Therefore, the tool-string must transverse down a cased-hole and may need to pass into a smaller diameter bore.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string.

In cased hole, logging tools are used to assess the strength of the cement bond between the casing and the wellbore wall and the condition of the casing. There are several types of sensors, and they typically need to be centered in the casing. One such logging tool utilises high frequency ultrasonic acoustic transducers and sensors to record circumferential measurements around the casing. The ultrasonic transmitter and sensor are mounted on a rotating head connected to the bottom of the tool. This rotating head spins and enables the sensor to record azimuthal ultrasonic reflections from the casing wall, cement sheath, and wellbore wall as the tool is slowly winched out of the wellbore. Other tools have transmitters and sensors that record the decrease in amplitude, or attenuation, of an acoustic signal as it travels along the casing wall. It is important that these transducers and sensors are well centered in the casing to ensure that the data recorded is valid. Other logging tools that measure fluid and gas production in flowing wellbores may also require sensor centralisation. Logging tools are also run in producing wells to determine flow characteristics of produced fluids. Many of these sensors also require centralisation for the data to be valid.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. As with the cased hole logging tools, the measurement from these sensors is optimised with good centralisation in the wellbore.

A common apparatus to centralise logging tools is a bow-spring centraliser. Bow-spring centralisers incorporate a number of curved leaf springs. The leaf springs are attached at their ends to an attachment structure that is fixed to the logging tool. The midpoint of the curved leaf spring (or bow springs) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are compressed, and the compressed bow springs provide a centering force on the tool string to hold it centrally in the bore.

Another known type of centraliser consists of several levers or arms with a wheel at or near where the levers are pivotally connected together. There are multiple sets of lever-wheel assemblies disposed at equal azimuths around the central axis of the device. There are typically between three and six sets. The ends of each lever set are connected to blocks which are free to slide axially on a central mandrel of the centraliser device. Springs are used force these blocks to slide toward each other forcing the arms to extend radially outward so that the wheels exert force against the wellbore wall. The centraliser device is typically energised by means of either axial or radial acting spring or a combination of both. The advantage of this type of centraliser is that drag is reduced by the wheels which roll, rather than slide along the wellbore wall.

A wireline logging tool-string is typically in the order of 20 ft to 100 ft long and 2" to 5" in diameter. Centralisers may be mounted to and spaced apart along the tool string to carry the tool string centrally in the bore. A centraliser should be placed on the tool string near to any sensor that must be centred in the bore. Even if a centraliser perfectly centres the section of tool string that it is carrying, a sensor in the tool string axially spaced from the centraliser may be off centre in the bore due to flex in the tool string and/or curvature of the wellbore as it transitions from a vertical section to a deviated section.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for centering sensor equipment in a bore or pipe.

According to one aspect of the present invention there is provided a device for centering a rotating sensor assembly in a wellbore, the rotating sensor assembly located at the bottom end (the terminal end) of a tool string, the device comprising:

- a centraliser comprising a plurality of arms spaced circumferentially apart around a longitudinal central axis of the device,
- a shaft with a mount for fixing the shaft to the rotating sensor assembly to extend below the rotating sensor assembly, so that the shaft and rotating sensor assembly rotate together on the longitudinal central axis,
- wherein the centraliser is rotationally mounted to the shaft to allow the shaft to rotate within the centraliser and with the centraliser positioned below the rotating sensor assembly.

In some embodiments, in use, an upper end of the shaft is connected to the rotating sensor assembly and the lower end of the shaft is a terminal end at the bottom end of the tool string.

In some embodiments, the centraliser supports the shaft between the upper connected end of the shaft and the lower terminal end of the shaft.

In some embodiments, the centraliser comprises a first support member and a second support member, the arms connected between the first and second support members,

- wherein one or both the first and second support members are adapted to move axially along the central longitudinal axis, and
- wherein the first and second support members are rotationally mounted to the shaft.

In some embodiments, the centralising device comprises a sleeve rotationally mounted to the shaft to allow for rotation of the shaft within the sleeve, the centraliser mounted to the sleeve to thereby rotationally mount the centraliser to the shaft.

In some embodiments, the device comprises an upper bearing located at or towards an upper end of the shaft and a lower bearing located at or towards the lower end of the shaft, the upper and lower bearings between the shaft and sleeve.

In some embodiments, the device comprises a pressure compensated bearing lubrication system, the pressure compensated bearing lubrication system comprising:

- a housing attached to a lower end of the sleeve,
- a resiliently deformable member attached to the housing, and
- a seal between the rotating shaft and the sleeve at the upper end of the sleeve,
- a sealed volume defined by the resiliently deformable member, an inside of the housing, an OD of the shaft, an ID of the sleeve, and the seal, the upper and lower bearings received in the sealed volume,
- in use the sealed volume filled with lubricant, the resiliently deformable member providing a movable interface between the wellbore fluid and the lubricant received in the sealed volume to pressure compensate the lubricant relative to the ambient pressure of the wellbore.

In some embodiments, the housing with the resiliently deformable member closes an end of the sleeve to cover a lower end of the shaft.

In some embodiments, the pressure compensated bearing lubrication system comprises a cover over the resiliently deformable member, the cover with at least one opening such that well bore pressure is applied to the resiliently deformable member.

In some embodiments, the resiliently deformable member is or comprises a bellows formation.

In some embodiments, the sealed volume is defined by an exterior of the bellows formation, the inside of the housing, the ID of the sleeve, the OD of the rotating shaft, and the seal.

In some embodiments, the pressure compensated bearing lubrication system comprises a flexible member,

- the bellows formation has an open end and a closed end, the flexible member sealingly connected to or over the open end of the bellows formation to form a chamber defined at least in part by an interior of the bellows formation and an inner surface of the flexible member, and
- in use the chamber filled with a fluid so that wellbore fluid acting on an external surface of the flexible member is communicated to the bellows formation.

In some embodiments, the centraliser comprises a first support member and a second support member axially spaced apart along a longitudinal axis of the device; and

- each arm is an arm assembly, the plurality of arm assemblies connected between the first and second support members, each arm assembly comprising:
  - a first arm pivotally connected to the first support member by a first pivot joint,
  - a second arm pivotally connected to the second support member by a second pivot joint, the first and second arms pivotally connected via a third pivot joint,
  - wherein one or both of the first and second support members is adapted to move axially along the longitudinal axis to allow the arm assemblies to extend and retract radially with respect to the longitudinal axis.

In some embodiments, each arm assembly comprises a roller or wheel to contact the wellbore wall. In some embodiments, the roller or wheel rotates around the third pivot joint.

In some embodiments, the centraliser comprises one or more spring elements to bias the arm assemblies radially outwards to contact the bore wall.

In some embodiments, the centraliser is a passive device, with energisation of the arms radially outwards being provided by one or more spring elements of the device only.

Unless the context suggests otherwise, the term "wellbore" may to refer to both cased and uncased wellbores. Thus, the term 'wellbore wall' may refer to the wall of a wellbore or the wall of a casing within a wellbore.

Unless the context suggests otherwise, the term "tool string" refers to an elongate sensor package or assembly also known in the industry as a "logging tool", and may include components other than sensors such as guide and orientation devices and carriage devices attached to sensor components or assemblies of the tool string. A tool string may include a single elongate sensor assembly, or two or more sensor assemblies connected together.

Unless the context suggests otherwise, the terms "upper", "lower", "top", "bottom" and similar such terms are used for convenience and ease of explanation. Such terms are not considered to be limiting to any particular orientation of a tool string or device comprising the invention in use. For example, when deployed in a horizontal bore or pipe, the "bottom end" or "lower end" of a tool string or device is the terminal end of the tool string or device. The "top end" is the end of the tool string connected to a conveyance means such as a wireline or drill pipe.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

In FIG. 6 a resiliently deformable member of the pressure lubrication system is shown in a compressed state.

In FIG. 7 the resiliently deformable member of the pressure lubrication system is shown in an uncompressed state.

BEST MODES FOR CARRYING OUT THE INVENTION

Figure 1:
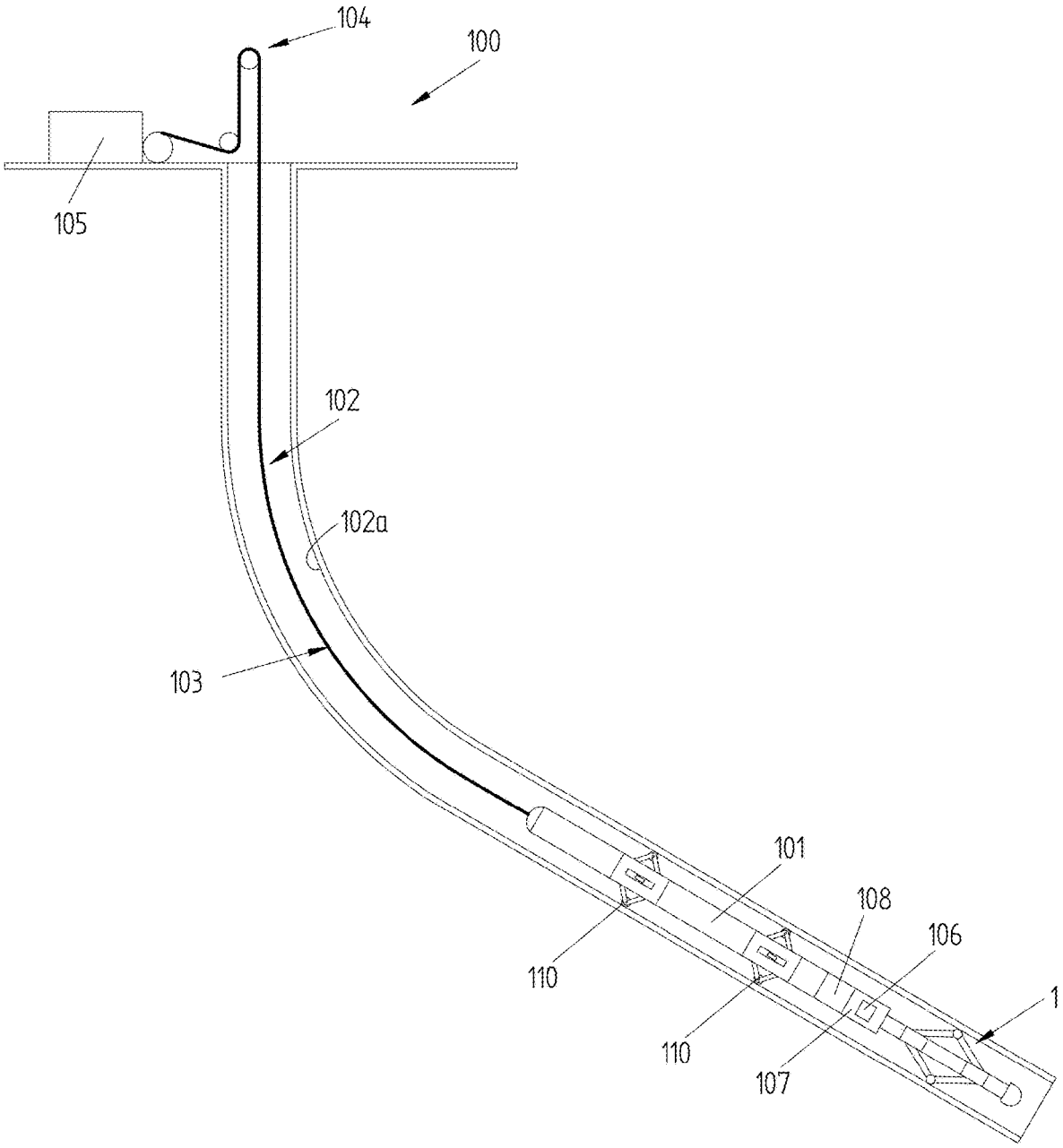
FIG. 1 is a schematic representation of a well site and a tool string descending a wellbore in a wireline logging operation.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 comprises one or more logging tools each carrying one or more sensors or sampling tools coupled together to form the logging tool string 101. The wireline 102 includes a number of wires or cables to provide electrical power to the one or more sensors and transmit sensor data to the wellsite surface. One or more centralising or other conveyance devices 110 may be provided along the logging tool 101 to centralise and convey the logging tool 101 in the wellbore 102.

The tool string 101 comprises a sensor 106 at the bottom end of the tool string. Sensor 106 is mounted on a rotating head 107 at the bottom end of the tool string 101. The rotating head 107 spins and enables the sensor 106 to record azimuthal signals from the casing wall, cement sheath, and/or wellbore wall as the tool string 101 is slowly winched out of the wellbore 102. The rotating head 107 and sensor 106 together form a rotating sensor assembly. The tool string 101 comprises a drive or motor 108 to drive rotation of the rotating sensor assembly. According to the present invention, a centralising device 1 is provided at the bottom end of the tool string 101 below the rotating sensor assembly. The drive 108 is in the tool string 101 above the rotating sensor assembly 106, 107, and the centralising device 1 is located below the rotating sensor assembly 106, 107.

Figure 2:
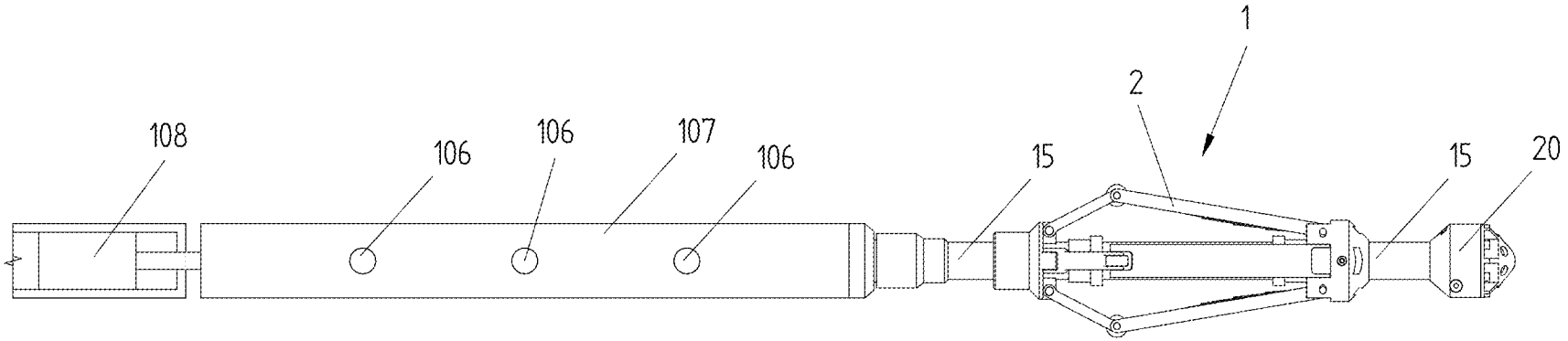
FIG. 2 is a schematic representation of a centralising device mounted to a rotating sensor assembly at the bottom end of a tool string, according to an embodiment of the present invention.
Figure 3:
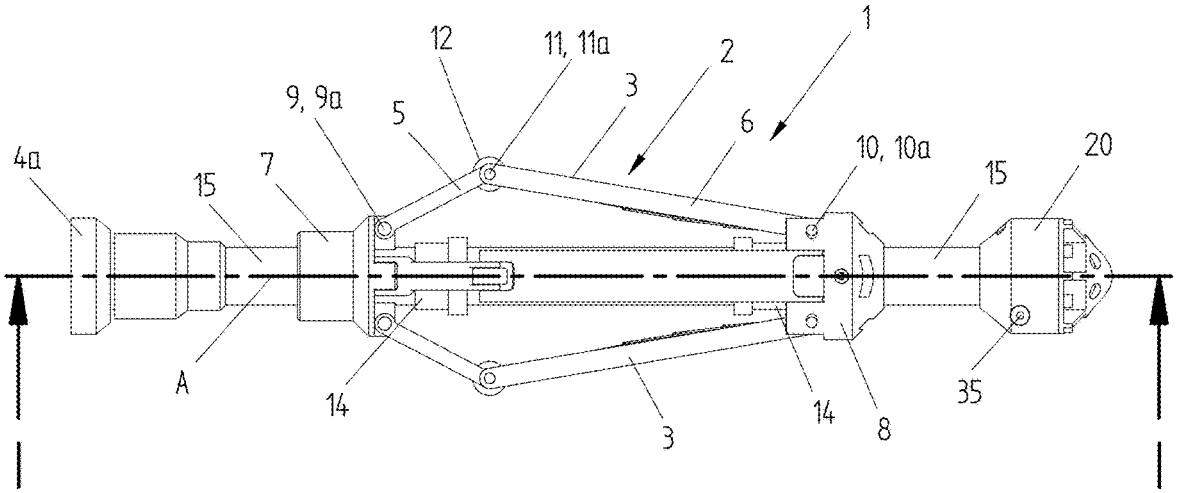
FIG. 3 is a side view representation of the centralising device, with arms of a centraliser of the centralising device in a radially outwards position.
Figure 4:
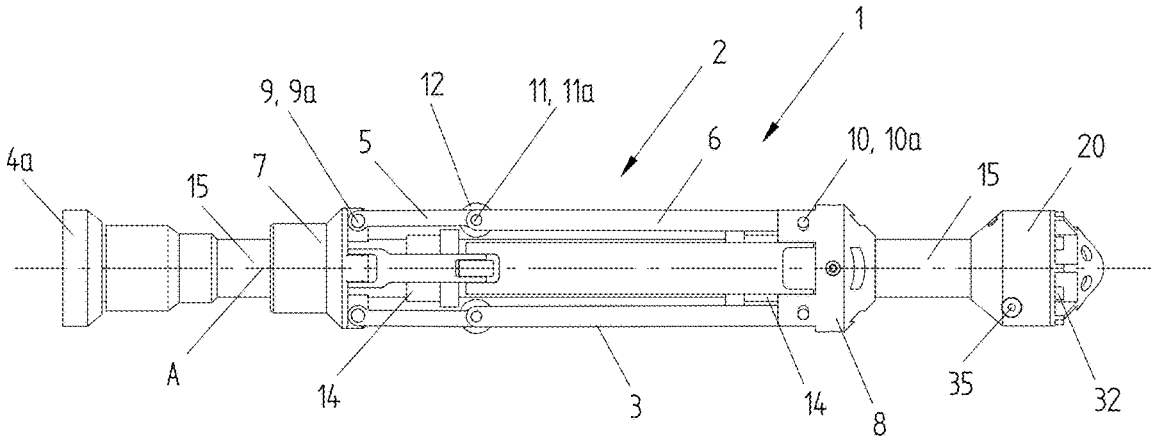
FIG. 4 is a side view representation of the centralising device, with the arms of the centraliser of the centralising device in a radially inwards position.
Figure 5:
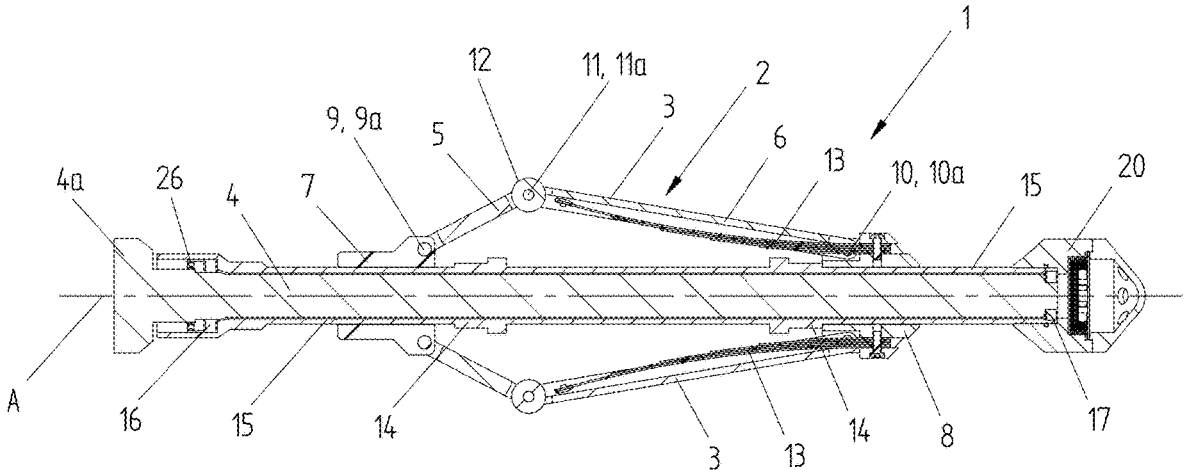
FIG. 5 is a cross-sectional view of the centralising device on line I-I shown in FIG. 3.

FIGS. 3 to 5 provide illustrate the centralising device 1. The centralising device 1 comprises a centraliser 2 mounted on a rotating shaft 4. The shaft 4 is fixed to the rotating head 107, as shown in FIG. 2, to rotate together with the rotating head 107 and sensor 106. The shaft 4 may comprise a flange 4*a* or other mount configured to fix the shaft 4 to the rotating head 107. Alternatively, the shaft may be integral with the rotating head. The flange may be fixed to the rotating head by fasteners such as bolts (not shown). The shaft 4 has a central longitudinal axis 'A' colinear with a central rotational axis of the rotating head 107. Such that the shaft 4 and rotating head 107 rotate together on the rotational axis A. An upper end of the shaft 4 is fixed to the rotating sensor assembly 107, 106. The shaft is cantilevered from the rotating sensor assembly. The upper end of the shaft 4 is connected to the rotating sensor assembly. The bottom end of the shaft 4 is the terminal end.

The centraliser 2 is rotationally mounted on the rotating shaft 4 to allow for rotation of the shaft 4. The shaft 4 can rotate without rotation of the centraliser 2. The rotational mounting of the centraliser 2 on the shaft 4 allows for the centraliser 2 to be rotationally static in the bore 102 (i.e. to not rotate relative to the bore 102). The centraliser 2 is free to rotate in the bore 102. However, the centraliser 2 is rotationally decoupled from the rotating shaft 4 and rotating head 107 and sensor 106 such that the centraliser 2 does not rotate with the shaft 4. Thus, the centraliser 2 can remain rotationally stationary in the bore 102 as the device 1 traverses the wellbore.

The centraliser 2 comprises a plurality of arms 3 spaced circumferentially apart around the longitudinal central axis A of the device 1. In the illustrated embodiment there are four arms 3, however the centraliser 2 may have three, four or more arms, for example five or six arms. The arms 3 are configured to move radially to engage the wellbore wall 102*a* to provide a centering force to maintain the shaft and therefore the rotating head 107 and sensor 106 at the centre of the wellbore 102. The centraliser 2 supports the shaft 4 between the upper end of the shaft and the lower end of the shaft. The upper end of the shaft is connected to the rotating head, and the lower end is the terminal end of the shaft, i.e. the terminal end is at the bottom end of the tool string.

In the illustrated embodiment each arm 3 is an arm assembly (or linkage assembly) comprising a first arm or link 5 and a second arm or link 6. The first arm 5 is pivotally connected to a first support member 7 by a first pivot joint 9, and the second arm 6 is pivotally connected to a second support member 8 by a second pivot joint 10. The first and second arms 5, 6 are pivotally attached together by a third pivot joint 11. Each pivot joint 9, 10, 11 has a pivot pin or axle on which the arms 5, 6 pivot about a pivot axis 9*a*, 10*a*, 11*a*, being an axis of the pin or axle.

In the illustrated embodiment each arm assembly 3 comprises a roller or wheel 12 located at the third pivot joint 11 to contact the wellbore wall 102*a*. In use the arm assemblies 3 are biased radially outwards so that the wheels 12 contact the wellbore wall to reduce friction between the wellbore wall 102*a* and the tool string 101 as the tool string 101 traverses the well bore 102. The wheel 12 may have a rotational axis colinear with the third pivot axis 11*a* of the third pivot joint 11, i.e. the wheel rotates around the third pivot joint. Alternatively, the wheel may be rotationally coupled to the first or second arm on a rotational axis adjacent to the third pivot axis 11*a*.

One or both support members 7, 8 are adapted to move axially along the axis A. Axial movement of one or both support members allows each arm assembly 3 to move radially to engage the wellbore wall 102 by pivoting of the first, second and third pivot joints 9, 10, 11. One or both support members 7, 8 may comprise a collar or annular member colinear with the shaft axis A.

The illustrated centraliser 2 is provided by way of example. Other alternative centralisers as known in the art may be provided to the rotating shaft 4. For example, in an alternative embodiment, each arm 3 is or comprises a bow spring connected between the first and second support members 7, 8.

The support members 7, 8 are mounted relative to the shaft 4 allow for rotation of the shaft 4 within each support member 7, 8. The rotational mounting of the support members 7, 8 with respect to the rotating shaft 4 allows for the centraliser 2 to be rotationally static in the bore 102 as described above. The support members are not rotationally keyed relative to the rotational shaft, to allow for relative rotation therebetween. Thus, the support members 7, 8 and arms 3 can remain rotationally static in the bore 102.

The centraliser 2 has one or more spring elements 13 to provide a force to the arms to force the arms 3 against the wellbore wall 102*a* to provide a centralising force to maintain the centralising device and therefore rotating sensor 106 centrally within the wellbore 102. In the illustrated embodiment, the centraliser 2 comprises leaf springs 13 (refer FIG. 5) acting on the second arm 6 to bias the arm assemblies 3 radially outwards against the wellbore wall 102*a*. Alternative spring arrangements may be provided, such as one or more axial springs acting on one or both support members 7, 8 to bias the support members 7, 8 axially inwards, thereby biasing the arms 3 radially outwards. Alternatively, as noted above, the arms may be bow-springs, where the bow-springs function as both the arms and spring elements. The springs are the only means of powering the arms radially outwards. There is no other power input to the device. The centraliser is therefore a passive device, with energisation of the arms radially outwards being provided only by the one or more springs.

In the illustrated embodiment, the leaf springs act on the second arms 6. The second arms 6 are longer than the first arms 5 to accommodate the radially acting springs 13. The centraliser 2 is arranged with the shorter first arms 5 upper most, nearest to the rotating sensor 106, to position the wheels 12 of the centraliser 2 as close to the sensor 106 as possible. Centralisation of the sensor 106 may be improved by placing the centraliser contact point with the wellbore (the wheels) as close to the sensor as possible.

The centraliser 2 comprises mechanical stops 14. The stops 14 set a maximum diameter for the centraliser 2. Each stop 14 limits inwards axial movement of the respective support member 7, 8, to limit the radial outward movement of the arms 3, whereby setting the maximum OD of the device.

As described above, the support members 7, 8 are mounted relative to the shaft to slide axially along the longitudinal axis A. In some embodiments, the support members may be mounted directly to the rotating shaft 4 to slide thereon. In the illustrated embodiment, and as best shown in FIG. 5, the centralising device 1 comprises a sleeve 15 rotationally mounted to the rotating shaft 4. The sleeve 15 is rotationally mounted on the rotating shaft 2 to allow for rotation of the shaft 4 within the sleeve 15. The shaft can rotate without rotation of the sleeve. The centraliser 2 is mounted to the sleeve 15, thereby rotationally mounting the centraliser 2 to the shaft 4. The centraliser 2, including arms 3, support members 7, 8, springs 13 and mechanical stops 14, is mounted to the sleeve 15, to rotationally mount the centraliser 2 to the shaft. This allows for the centraliser 2 to be rotationally static in the bore 102, as described above. The support members 7, 8 may be free to rotate on the sleeve 15. Alternatively, the support members 7, 8 may be keyed to the sleeve to prevent relative rotation therebetween. One or both stops 14 may be fixed to the sleeve 15 or may be integrally formed with the sleeve 15.

Figure 6:
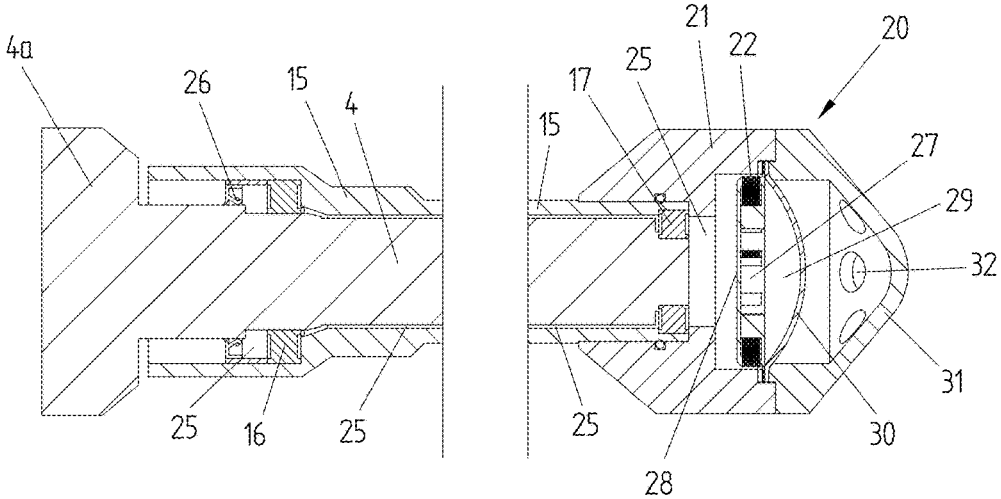
FIG. 6 is a part cross-sectional view on line I-I of the centralising device shown in FIG. 3, illustrating an upper end and a lower end of a pressure lubrication system of the device of FIG. 3.

As best shown in FIG. 6, in the illustrated embodiment the sleeve 15 is mounted to the rotating shaft 4 via bearings 16, 17. One bearing 16 is located at or towards an upper end of the shaft 4 (the end connected to the rotating head 107) and the other bearing 17 is located at or towards the terminal lower end of the shaft. Each bearing 16, 17 may for example comprise roller elements, such as ball bearings or roller bearings (roller elements not illustrated). The bearings 16, 17 may comprise an inner race mounted to the shaft and an outer race mounted to the sleeve with roller elements between the races. Alternatively, the bearings 16, 17 may comprise roller elements such as balls or pins captured between the sleeve and shaft, i.e. the sleeve and shaft provide the inner and outer races. The bearings 16, 17 provide for a low friction rotating interface between the sleeve 15 and the shaft 4.

The illustrated centralising device 1 comprises a pressure compensated bearing lubrication system 20. The lubrication system 20 provides lubricant to the bearings 16, 17 at a pressure greater than an ambient pressure in the wellbore (the wellbore pressure or ambient wellbore pressure).

Figure 7:
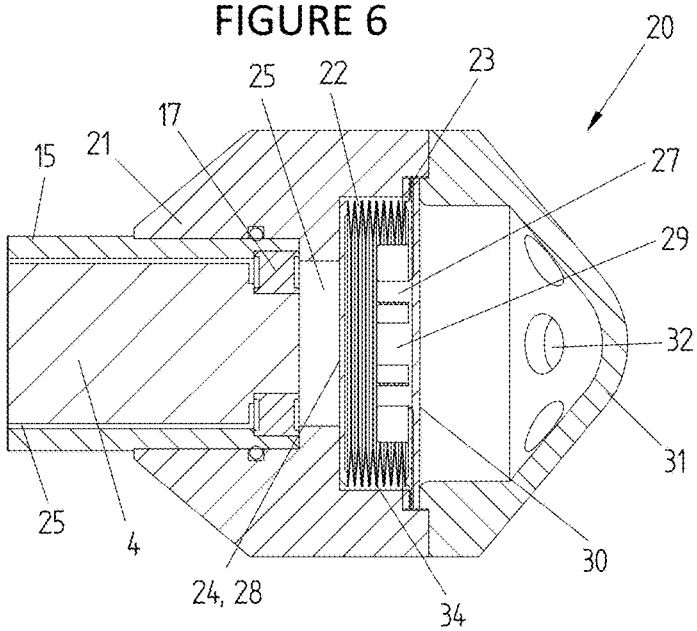
FIG. 7 is a part cross-sectional view of the centralising device on line I-I shown in FIG. 3.

With reference to FIGS. 6 and 7, the lubrication system comprises a housing 21 within which is provided a resiliently deformable member 22. The resiliently deformable member 22 is sealingly attached to the housing 21 at mounting flange 23. The resiliently deformable member has a mounting flange 23 to mount the resiliently deformable member to the housing. The flange may provide a seal with the housing, or a seal may be provided between the flange and housing. The housing 21 is attached to the sleeve 15. The housing 21 is attached to a lower end of the sleeve 15. Such that an inside of the housing is in communication with an inside of the sleeve. The housing 21 with resiliently deformable member 22 closes an end of the sleeve 15, to cover a lower end of the shaft 4. An opposite upper end of the sleeve 15 is sealed by a seal 26 acting between the rotating shaft 4 and the sleeve 15. For example, the seal 26 may comprise a lip seal or mechanical seal. With the resiliently deformable member 22 mounted to the housing 21, the resiliently deformable member 22 seals or closes the housing 21 to provide a sealed volume 25 defined by the resiliently deformable member, an inner surface of the housing 21, an annular space between the sleeve 21 and the rotating shaft 4, and the seal 26. Thus, the sealed volume 25 extends between the resiliently deformable member 22 and the seal 26. The sealed volume 25 is filled with lubricant in use. The bearings 16 and 17 are received within the sealed volume and are therefore immersed in the lubricant received in the sealed volume 25. In FIG. 6 the bearings are shown schematically, however, one skilled in the art will understand a bearing assembly comprising roller elements such as balls has a flow path for lubricant to flow through the bearings. The resiliently deformable member 22 provides a movable interface between the wellbore fluid and the lubricant received in the sealed volume 25 to pressure compensate the lubricant relative to the ambient pressure of the wellbore.

In the illustrated embodiment, the resiliently deformable member comprises a bellows formation 22. The bellows formation has an open end 27 and a closed end 28. A flexible member 30, for example a sheet of rubber or resilient diaphragm such as an elastomeric diaphragm, is sealingly connected to or over the open end 27 of the bellows formation.

FIG. 6 shows the bellows 22 in a compressed state and the flexible member in an inflated state. FIG. 7 shows the bellows 22 in an expanded state and the flexible member in an uninflated state. The flexible member 30 may be mounted or connected to the housing 21, to provide a second volume or a chamber 29 defined by an interior of the bellows 22, and an inner surface of the flexible member 30. A cover 31 is preferably provided over the flexible member 30 and clamps the flexible member 30 to the housing 21. The cover 31 is provided with at least one opening 32 such that the external surface of the flexible member 30 is in communication with the wellbore fluids that surround centralising device 1 in use. The cover may be fixed to the housing by fasteners such as screws (e.g. screws 32, FIG. 4).

A substantially incompressible fluid, for example silicone oil, is provided in the chamber 29 defined (at least in part) by the interior of the bellows formation 22 and the inner surface of the flexible member 30. The oil is substantially incompressible, such that any expansion or contraction of the bellows formation 22 causes deflection of the flexible member 30 and vice versa. In operation, deflection of the bellows formation may be due to thermally and pressure induced volume changes of the lubricant received in the sealed volume 25 or minor loss of lubricant through the seal 26.

The bellows formation 22 is preferably formed from a metal, for example Inconel or stainless steel. In preferred embodiments multiple annular metal rings 34 are welded together to form the bellows formation 22. The metal rings may be beveled metal rings. The bellows formation is preferably a spring bellows formation so that a force is required to compress the bellows from an expanded configuration to a compressed or less expanded configuration. The formation is preferably elastically deformable along the central axis A.

The inside of the bellows may be filled with the substantially incompressible fluid and then the flexible diaphragm and cover assembled to the housing to contain the fluid in the chamber 29.

The sealed volume 25 is defined by an exterior 24 of the bellows formation 22, the inner surface of the housing 21, an ID of the sleeve 15, an OD of the rotating shaft 4, and the seal 26. The volume 25 is filled with a lubricant before use via a one-way valve (valve 35, FIG. 4). With the housing filled with lubricant, the exterior of the bellows is immersed in the lubricant. The exterior of the bellows faces the lubricant or is exposed to the lubricant. The lubricant is preferably pressurised sufficiently when filling the volume 25 to cause a compression of the bellows formation 22. Compression of the bellows 22 causes movement of the fluid in chamber 29 to cause outwards deflection of the flexible member 30, as shown in FIG. 6.

The deflection of the flexible member 30 may be limited to around 10% or less elongation, to ensure that the flexible member 30 does not wear out or fail due to fatigue after repeated uses. Preferably the lubrication system can be used on multiple runs in the wellbore with minimal maintenance between runs, in other words reusable. The bellows may be damaged if wellbore cuttings become lodged between the metal rings that form the spring bellows. By providing the flexible member 30 to define a chamber 29 with the interior of the bellows, and filling the chamber 29 with a fluid, the bellows 22 is separated from the wellbore fluid and wellbore cuttings and debris. Thus, the lubrication system comprising the flexible member and chamber filled with fluid prevents wellbore cuttings and debris from interfering with the bellows formation.

In use, the ambient pressure of the wellbore fluid surrounding the tool string and centralising device 1 bears on the outer surface of the flexible member 30. The flexible member 30 deflects under the ambient pressure, transferring the pressure through the fluid in chamber 29 to the interior of the bellows formation 22. The bellows formation is free to expand axially to allow the transfer of pressure to the lubricant in the sealed volume 25. In use, the bellows formation is elastically compressed and consequently provides additional pressure to the lubricant in the sealed volume 25. In other words, the bellows provides a bias force against the lubricant in the housing. The bellows is biased to an expanded configuration. For example, the bellows is constructed in an expanded configuration, for example as in FIG. 7, and a force is required to deflect the bellows formation from the expanded configuration to a compressed or less expanded configuration, for example as in FIG. 6. In this way the pressure of the lubricant within the bearings 16, 17 and on the inside of the shaft seal 26 is kept at a slightly higher pressure (for example around 20 psi higher) than the ambient wellbore pressure on the outside the seal 26, regardless of any change in wellbore pressure. In this way, the bearings remain immersed in the lubricant, to ensure a low friction rotational interface between the rotating shaft 4 and the sleeve and centraliser 2. A low friction rotational interface is important given the rotation of shaft 4 is driven by a drive mechanism 108 designed to drive rotation of the rotating head 107. Friction between the rotating shaft 4 and centraliser 2 introduces additional load that the rotating head drive 108 must overcome.

In an alternative embodiment the resiliently deformable member may comprise the flexible member 30 (e.g. without the inclusion of a bellows formation 22). For example, a sheet of rubber or resilient diaphragm such as an elastomeric diaphragm may provide the movable interface between the wellbore fluid and the lubricant in the sealed volume 25. In such an embodiment, the sealed volume 25 may be defined by an inner side of the flexible member 30, the inner surface of the housing 21, an ID of the sleeve 15, an OD of the rotating shaft 4, and the seal 26. In use, the ambient pressure of the wellbore fluid surrounding the tool string and centralising device 1 bears on the outer surface of the flexible member 30. The flexible member 30 deflects under the ambient pressure, transferring the pressure to the lubricant in the sealed volume 25. Before use, the sealed volume is filled with lubricant via valve 35 (FIG. 4). The lubricant is preferably pressurised sufficiently when filling the volume 25 to cause the flexible member to elastically expand. Elastic expansion of the flexible member provides a bias to pressurise the lubricant. Thus, the pressure of the lubricant within the bearings 16, 17 and on the inside of the shaft seal 26 is kept at a slightly higher pressure (for example around 5 psi higher) than the ambient wellbore pressure on the outside the seal 26, regardless of any change in wellbore pressure.

The compensated lubrication system is practically frictionless and responds immediately to changes in wellbore pressure to maintain a small positive pressure differential between the lubricant and the well bore environment. A small pressure differential (for example less than 20 psi) is optimal to minimise friction of the seal 26 between the rotating shaft 4 and the sleeve 15.

In the illustrated embodiment the centraliser 2 is mounted on a single sleeve 15. Alternatively, each support member may be mounted on a separate sleeve. In a further alternative embodiment, each support member may be mounted directly to the shaft 4. However, such alternative embodiments introduce complexity where a bearing system is desirable between the centraliser 2 and rotating shaft 4, and in particular a bearing system immersed in a compensated lubrication system.

Centralisation is improved by locating the centraliser below the rotating sensor. The centraliser 2 is positioned close to the sensor 106, precisely where centralisation is needed, to ensure high quality data. Further, another centraliser 110 may be located above the rotating sensor 106, such that the rotating sensor assembly 106, 107 is supported by a centraliser (110, FIG. 1) positioned above and the centraliser 2 below the rotating sensor assembly. Locating the centraliser on a rotating shaft connected to the rotating head 107 below the sensor 106 at the very bottom of the tool string may improve centralisation of the sensor 106, particularly in curved or dog-logged sections of the wellbore 102.

The invention has been described with reference to centering a tool string in a wellbore during a wireline logging operation. However, a centralising device according to the present invention may be used for centering a rotating sensor assembly in a bore in other applications, for example to center a rotating camera in a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for centering a rotating sensor assembly in a wellbore, the rotating sensor assembly located at the bottom end of a tool string, the device comprising:

a centraliser comprising a plurality of arms spaced circumferentially apart around a longitudinal central axis of the device, a shaft with a mount for fixing the shaft to the rotating sensor assembly to extend below the rotating sensor assembly, so that the shaft and rotating sensor assembly rotate together on the longitudinal central axis, wherein the centraliser is rotationally mounted to the shaft to allow the shaft to rotate within the centraliser and with the centraliser positioned below the rotating sensor assembly, and in use, an upper end of the shaft is connected to the rotating sensor assembly, and the lower end of the shaft is a terminal end at the bottom end of the tool string.

2. The device as claimed in claim 1, wherein the centraliser supports the shaft between the upper connected end of the shaft and the lower terminal end of the shaft.

3. The device as claimed in claim 2, wherein the centraliser comprises a first support member and a second support member, the arms connected between the first and second support members, wherein one or both the first and second support members are adapted to move axially along the central longitudinal axis, and wherein the first and second support members are rotationally mounted to the shaft.

4. The device as claimed in claim 1, wherein the centralising device comprises a sleeve rotationally mounted to the shaft to allow for rotation of the shaft within the sleeve, the centraliser mounted to the sleeve to thereby rotationally mount the centraliser to the shaft.

5. The device as claimed in claim 4, wherein the device comprises an upper bearing located at or towards an upper end of the shaft and a lower bearing located at or towards the lower end of the shaft, the upper and lower bearings between the shaft and sleeve.

6. The device as claimed in claim 5, wherein the device comprises a pressure compensated bearing lubrication system, the pressure compensated bearing lubrication system comprising:

a housing attached to a lower end of the sleeve, a resiliently deformable member attached to the housing, and a seal between the rotating shaft and the sleeve at the upper end of the sleeve, a sealed volume defined by the resiliently deformable member, an inside of the housing, an OD of the shaft, an ID of the sleeve, and the seal, the upper and lower bearings received in the sealed volume, in use the sealed volume filled with lubricant, the resiliently deformable member providing a movable interface between the wellbore fluid and the lubricant received in the sealed volume to pressure compensate the lubricant relative to the ambient pressure of the wellbore.

7. The device as claimed in claim 6, wherein the housing with the resiliently deformable member closes an end of the sleeve to cover a lower end of the shaft.

8. The device as claimed in claim 6, wherein the pressure compensated bearing lubrication system comprises a cover over the resiliently deformable member, the cover with at least one opening such that well bore pressure is applied to the resiliently deformable member.

9. The device as claimed in claim 6, wherein the resiliently deformable member is or comprises a bellows formation or a flexible member.

10. The device as claimed in claim 9, wherein the resiliently deformable member is the bellows formation and the sealed volume is defined by an exterior of the bellows formation, the inside of the housing, the ID of the sleeve, the OD of the rotating shaft, and the seal.

11. The device as claimed in claim 9, wherein the pressure compensated bearing lubrication system comprises a flexible member, The bellows formation has an open end and a closed end, the flexible member sealingly connected to or over the open end of the bellows formation to form a chamber defined at least in part by an interior of the bellows formation and an inner surface of the flexible member, and In use the chamber filled with a fluid so that wellbore fluid acting on an external surface of the flexible member is communicated to the bellows formation.

12. The device as claimed in claim 1, wherein the centraliser comprises a first support member and a second support member axially spaced apart along a longitudinal axis of the device; and each arm is an arm assembly, the plurality of arm assemblies connected between the first and second support members, each arm assembly comprising:

a first arm pivotally connected to the first support member by a first pivot joint, a second arm pivotally connected to the second support member by a second pivot joint, the first and second arms pivotally connected via a third pivot joint, wherein one or both of the first and second support members is adapted to move axially along the longitudinal axis to allow the arm assemblies to extend and retract radially with respect to the longitudinal axis.

13. The device as claimed in claim 12, wherein each arm assembly comprises a roller or wheel to contact the wellbore wall.

14. The device as claimed in claim 12, wherein the centraliser comprises one or more spring elements to bias the arm assemblies radially outwards to contact the bore wall.

15. The device as claimed in claim 1, wherein the centraliser is a passive device, with energisation of the arms radially outwards being provided by one or more spring elements of the device only.

16. A device for centering a rotating sensor assembly in a wellbore, the rotating sensor assembly located at the bottom end of a tool string, the device comprising:

a centraliser comprising a plurality of arms spaced circumferentially apart around a longitudinal central axis of the device, a shaft with a mount for fixing the shaft to the rotating sensor assembly to extend below the rotating sensor assembly, so that the shaft and rotating sensor assembly rotate together on the longitudinal central axis, wherein the centraliser is rotationally mounted to the shaft to allow the shaft to rotate within the centraliser and with the centraliser positioned below the rotating sensor assembly, and a sleeve rotationally mounted to the shaft to allow for rotation of the shaft within the sleeve, the centraliser mounted to the sleeve to thereby rotationally mount the centraliser to the shaft, and an upper bearing located at or towards an upper end of the shaft and a lower bearing located at or towards the lower end of the shaft, the upper and lower bearings between the shaft and sleeve.

17. The device as claimed in claim 16, wherein the device comprises a pressure compensated bearing lubrication system, the pressure compensated bearing lubrication system comprising:

a housing attached to a lower end of the sleeve, a movable interface mounted to the housing, and a seal between the rotating shaft and the sleeve at the upper end of the sleeve, a sealed volume defined by the moveable interface, an inside of the housing, an OD of the shaft, an ID of the sleeve, and the seal, the upper and lower bearings received in the sealed volume, in use the sealed volume filled with lubricant, wherein wellbore fluid acting on the movable interface pressure compensates the lubricant received in the sealed volume relative to the ambient pressure in the wellbore.

18. The device as claimed in claim 16, wherein the housing with the movable interface closes an end of the sleeve to cover a lower end of the shaft.

19. The device as claimed in claim 18, wherein the pressure compensated bearing lubrication system comprises a cover over the moveable interface, the cover with at least one opening such that well bore pressure is applied to the moveable interface.

20. The device as claimed in claim 18, wherein the movable interface is or comprises a bellows formation or a flexible member.

* * * * *